US010480473B2

(12) United States Patent
Zhang et al.

(10) Patent No.: US 10,480,473 B2
(45) Date of Patent: Nov. 19, 2019

(54) FUEL INJECTOR

(71) Applicant: Ford Global Technologies, LLC, Dearborn, MI (US)

(72) Inventors: Xiaogang Zhang, Novi, MI (US); Mark Meinhart, Dexter, MI (US); Jianwen James Yi, West Bloomfield, MI (US); George Papaioannou, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/841,036

(22) Filed: Dec. 13, 2017

(65) Prior Publication Data

US 2019/0178214 A1 Jun. 13, 2019

(51) Int. Cl.
*F02M 61/18* (2006.01)
*F02M 47/02* (2006.01)

(52) U.S. Cl.
CPC .... *F02M 61/1833* (2013.01); *F02M 61/1813* (2013.01); *F02M 47/027* (2013.01); *F02M 61/184* (2013.01)

(58) Field of Classification Search
CPC ..... F02M 47/027; F02M 61/1813; F02M 61/184; F02M 61/1833; F02M 61/1826; F02M 61/1846
See application file for complete search history.

(56) References Cited

U.S. PATENT DOCUMENTS

| | | | | |
|---|---|---|---|---|
| 4,408,722 | A | 10/1983 | Frelund | |
| 5,199,647 | A * | 4/1993 | Yoshizu | F02M 61/16 239/533.12 |
| 5,431,346 | A | 7/1995 | Sinaisky | |
| 6,042,028 | A | 3/2000 | Xu | |
| 6,045,063 | A | 4/2000 | Koike et al. | |
| 6,065,691 | A | 5/2000 | West | |
| 6,817,545 | B2 | 11/2004 | Xu | |
| 7,458,364 | B2 | 12/2008 | Allen | |
| 2010/0123031 | A1 * | 5/2010 | Weber | F02M 47/027 239/589.1 |
| 2016/0123286 | A1 * | 5/2016 | Hou | F02M 43/04 123/299 |
| 2017/0284354 | A1 * | 10/2017 | Powell | F02M 61/184 |

FOREIGN PATENT DOCUMENTS

WO 2004042221 A2 5/2004

* cited by examiner

*Primary Examiner* — Hai H Huynh
*Assistant Examiner* — Gonzalo Laguarda
(74) *Attorney, Agent, or Firm* — Geoffrey Brumbaugh; McCoy Russell LLP

(57) ABSTRACT

A fuel injector and method are disclosed including an injector body with a fuel sac, and an end positioned into a combustion chamber. A main fuel passage, having a varying cross-sectional area forming a reduced pressure region, fluidically couples the fuel sac to the combustion chamber. One or more additional passages fluidically couple the reduced pressure region with one or both of the fuel sac and the combustion chamber.

19 Claims, 8 Drawing Sheets

FUEL INJECTOR

FIELD

The present invention relates to fuel injectors, and in particular to a fuel injector having a nozzle configuration to pull fuel from the fuel sac, and/or warm gas from the combustion chamber to yield faster fuel evaporation and reduced combustion chamber penetration.

BACKGROUND/SUMMARY

During the operation of combustion engines the quality of the combustion events depends on various conditions. One condition is how well the fuel is mixed with air in the combustion chamber. A poor air fuel mix may yield unwanted soot, and/or hydrocarbon emissions. This may be, in particular, during cold starts. One contributing factor to poor mixing is fuel impingement onto the top surface of surface of the piston as it moves within the combustion chamber. Long spray penetration, may result in the spray hitting the top surface of the piston, which may tend to keep the fuel at a cooler, liquefied, state. Fuel injectors have been used to inject fuel at high velocity in an attempt to atomize the fuel. Still, impingement onto the surface of the piston may still occur.

U.S. Pat. No. 7,458,364 to Allen discloses a fuel injection system wherein an attempt is made to improve atomization. The '364 disclosure includes a so called mixing chamber into which a positive displacement pump injects a measured amount of fuel. An air, or exhaust gas, conduit provides a gaseous make-up volume to the mixing chamber as a partial vacuum is produced in the adjacent combustion chamber to pull exhaust gas and fuel into the combustion chamber in a combined stream in an attempt to entrain the fuel into the exhaust stream. The vacuum is created in the combustion chamber by delaying the opening of an inlet valve as the piston starts a downward stroke. The mixing chamber includes an atomizing nozzle at an outlet side thereof, to accelerate the flow.

This approach has a number of shortcomings. For one, the '364 system requires a very particular operation of the charge air inlet valve in order to create a vacuum in the combustion chamber to cause air or exhaust to flow through the mixing chamber to entrain the fuel. The '364 design is intended to be used with smaller single cylinder engines that do not include a fuel pump. The positive displacement pump is designed for metered injection, not for increased pressure. In addition, there appears to be a relatively short time during which the fuel is exposed to the passing air or exhaust flow. There also appears to be little time for any appreciable heat transfer between the fuel and exhaust. The stream of exhaust and stream of fuel appear to be merely blended. It appears the fuel only becomes atomized as it passes from the atomizing nozzle into the combustion chamber within the blend.

The inventors herein disclose an engine, a fuel injector, and a method of injecting fuel into a combustion chamber of the engine that reduces the likelihood of impingement of the injected fuel onto the top surface of the piston, and provides an improved air-fuel mixture.

Embodiments may provide a fuel injector that may include an injector body. An end of the injector body may be configured to be positioned into a combustion chamber. A fuel sac may be defined within the injector body, and a main fuel passage may fluidically couple the fuel sac to the combustion chamber. The main fuel passage may have a varying cross-sectional area to form a reduced pressure region. An additional passage may fluidically couple the reduced pressure region with one of the fuel sac and the combustion chamber.

In this way, the low pressure region may cause some fuel to pass through the additional passage from the fuel sac into the main fuel passage, and may disrupt the flow to cause better mixing and/or more effective spreading of the fuel upon leaving the injector. Also, or instead, in this way the low pressure region may cause some warmed gasses from the combustion chamber to pass through the additional passage from the combustion chamber into the main fuel passage, and warm the fuel injected from the injector. Also, or instead, in this way, the low pressure region may create an area of low pressure to a side of the exit stream of the fuel from the injector outlet. In this way, the stream of fuel exiting the nozzle outlet may be made wider, may spread.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
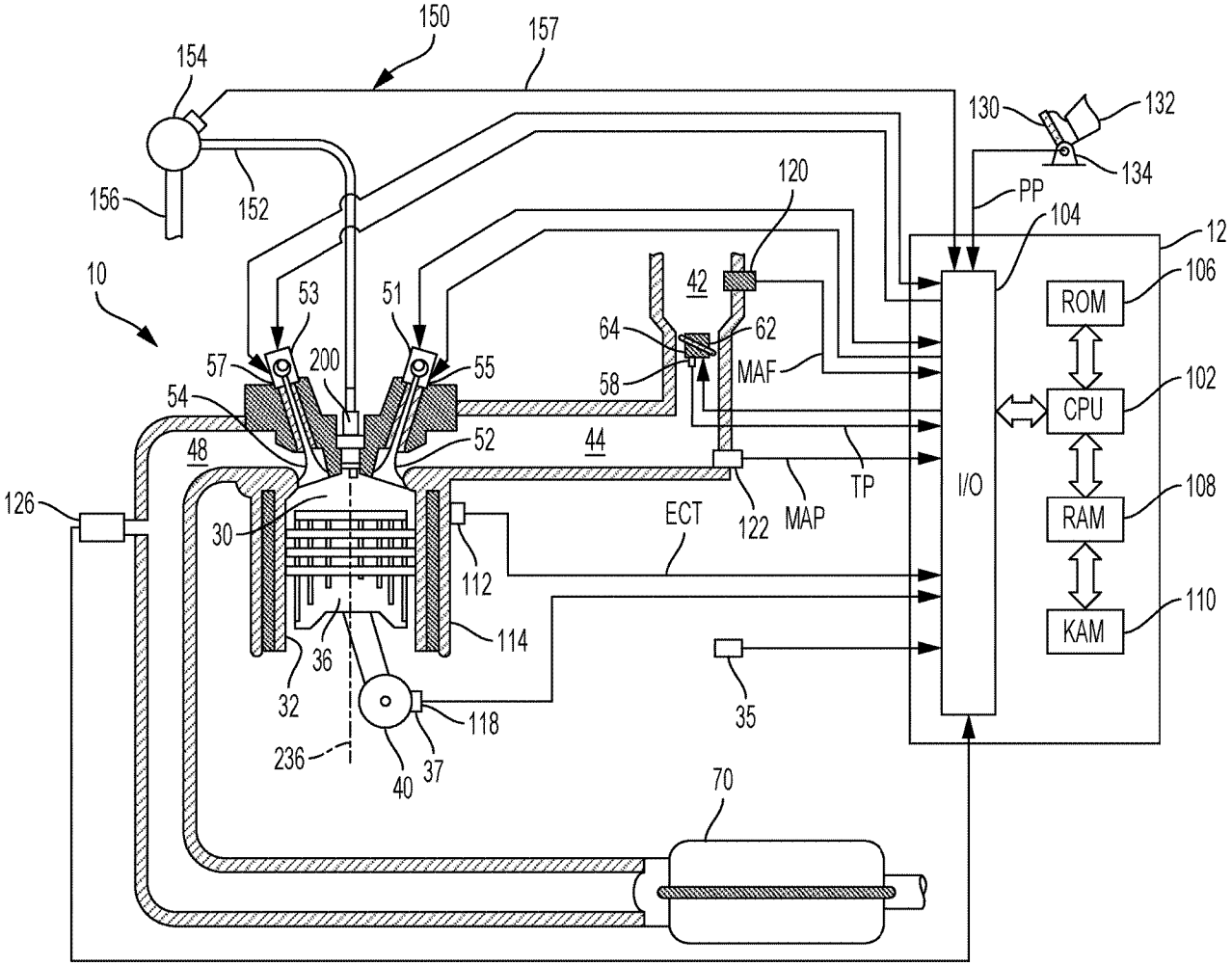
FIG. 1 is a schematic system diagram of an engine in accordance with the present disclosure.

Referring to FIG. 1, an internal combustion engine 10, comprising a plurality of cylinders, one cylinder of which is shown in FIG. 1, may be controlled by electronic engine controller 12. The engine 10 may include one or more combustion chambers 30 each defined substantially by a cylinder wall 32. A piston 36 may be positioned within the combustion chamber 30 for reciprocal motion therein, and connected to a crankshaft 40 to transmit a motive force created by movement of the piston 36. A flywheel (not shown) may be coupled to the crankshaft 40. A piston position sensor 37 is illustrated positioned in conjunction with the crankshaft 40, to sense, and/or otherwise determine the height, or position, of the piston 36 in the cylinder, i.e. the combustion chamber 30. A signal indicative of the distance between the piston 36 and the fuel injector 200 may be sent to the engine controller 12.

The combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake cam 51 and exhaust cam 53 may be moved relative to crankshaft 40.

Fuel injector 200 is shown positioned to inject fuel directly into cylinder 30, which is known to those skilled in the art as direct injection. Alternatively, fuel may be injected to an intake port, which is known to those skilled in the art as port injection. Fuel injector 200 may deliver a liquid fuel in proportion to the pulse width of signal from controller 12. Fuel may be delivered to fuel injector 200 via a fuel system 150, which may include a fuel tank, (not shown) and a fuel pump 154, coupled to the fuel tank via an upstream fuel line 156.

Intake manifold 44 is shown communicating with optional electronic throttle 62 which adjusts a position of throttle plate 64 to control air flow from air intake 42 to intake manifold 44. In one example, a low pressure direct injection system may be used, where fuel pressure can be raised to approximately 20-30 bar. Alternatively, a high pressure, dual stage, fuel system may be used to generate higher fuel pressures. In some examples, throttle 62 and throttle plate 64 may be positioned between intake valve 52 and intake manifold 44 such that throttle 62 is a port throttle.

An ignition system (not shown) may provide an ignition spark to combustion chamber 30 via spark plug (not shown) in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126. In another example, the engine may be coupled to an electric motor/battery system in a hybrid vehicle. The engine 10 may be a diesel engine, and may not utilize a spark, or ignition system, as is illustrated in the example engine 10 shown in FIG. 1.

Catalytic converter 70 may include multiple catalyst bricks, in one example. In another example, multiple emission control devices, each with multiple bricks, can be used. Catalytic converter 70 can be a three-way type catalyst in one example. A temperature of catalytic converter 70 may be measured or estimated via engine speed, engine load, engine coolant temperature, and spark timing.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; a measure of road grade from inclinometer 35, and a measurement of throttle position from sensor 58. Barometric pressure may also be sensed (sensor not shown) for processing by controller 12.

In a preferred aspect of the present description, engine position sensor 118 produces a predetermined number of equally spaced pulses every revolution of the crankshaft from which engine speed (RPM) can be determined. The engine position sensor 118 and the position location sensor 37 may be the same sensor.

During operation, each cylinder within engine 10 may typically undergo a four stroke cycle: the cycle may include the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber 30. In a process hereinafter referred to as ignition. The fuel may be combusted via auto ignition via increased compression, or via spark. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Controller 12 may be configured to receive inputs from engine 10, as shown in more detail in FIG. 1, and accordingly control a torque output of the engine and/or operation of the torque converter, transmission, DISG, clutches, and/or brakes. In the case of a diesel engine, controller 12 may control the engine torque output by controlling a combination of fuel pulse width, fuel pulse timing, and air charge. Engine control may be performed on a cylinder-by-cylinder basis to control the engine torque output.

As mentioned the engine 10 may include a fuel system 150. A fuel line 152 may be included to supply a high pressure fuel for combustion in the combustion chamber 30. The engine system 150 may include a fuel pump 154 configured to move fuel from a fuel tank (not shown) via the upstream fuel line 156. The fuel pump 154 may also pressurize the fuel to thereby provide high pressure fuel. A fuel control line 157 may operatively couple the fuel pump 156 with the controller 12.

The engine 10 may include an EGR system (not shown). An exhaust gas recirculation (EGR) line and EGR valve may be provided to at least partially regulate the EGR system.

Figure 2B:
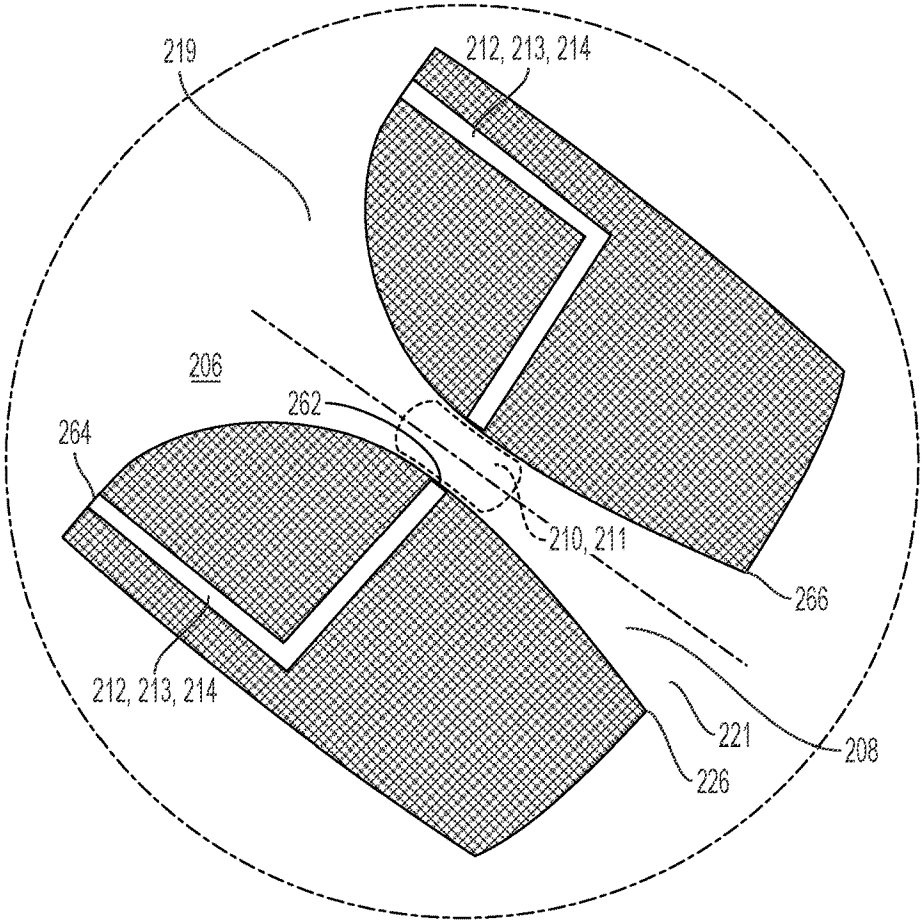
FIG. 2B is a scaled up detailed cross-sectional view of a portion of the fuel injector illustrated in FIG. 2A in accordance with the present disclosure.
Figure 2A:
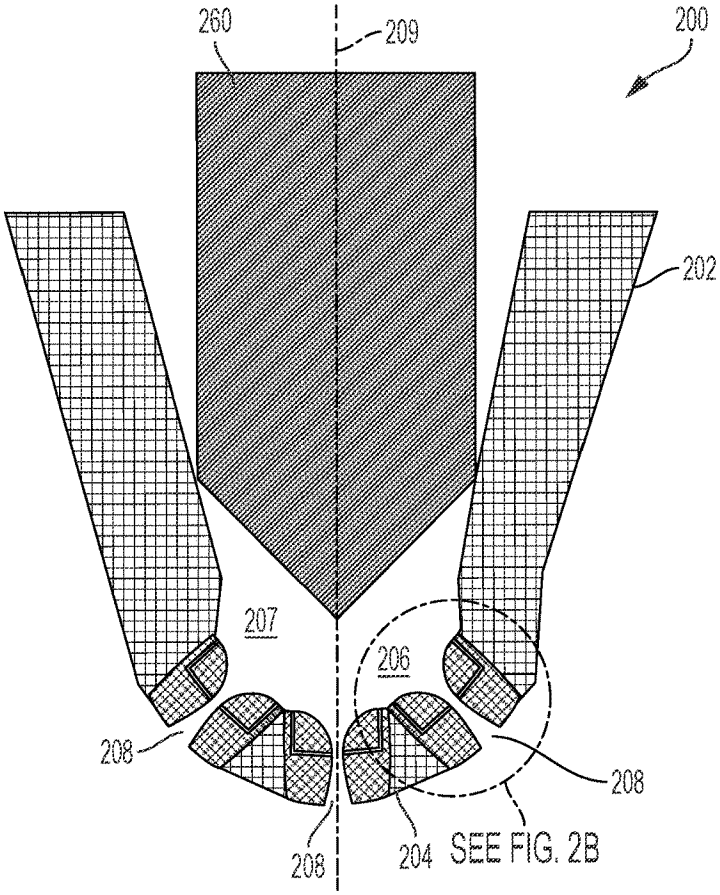
FIG. 2A is a cross-sectional view of a valve body of a fuel injector in accordance with the present disclosure.
Figure 3B:
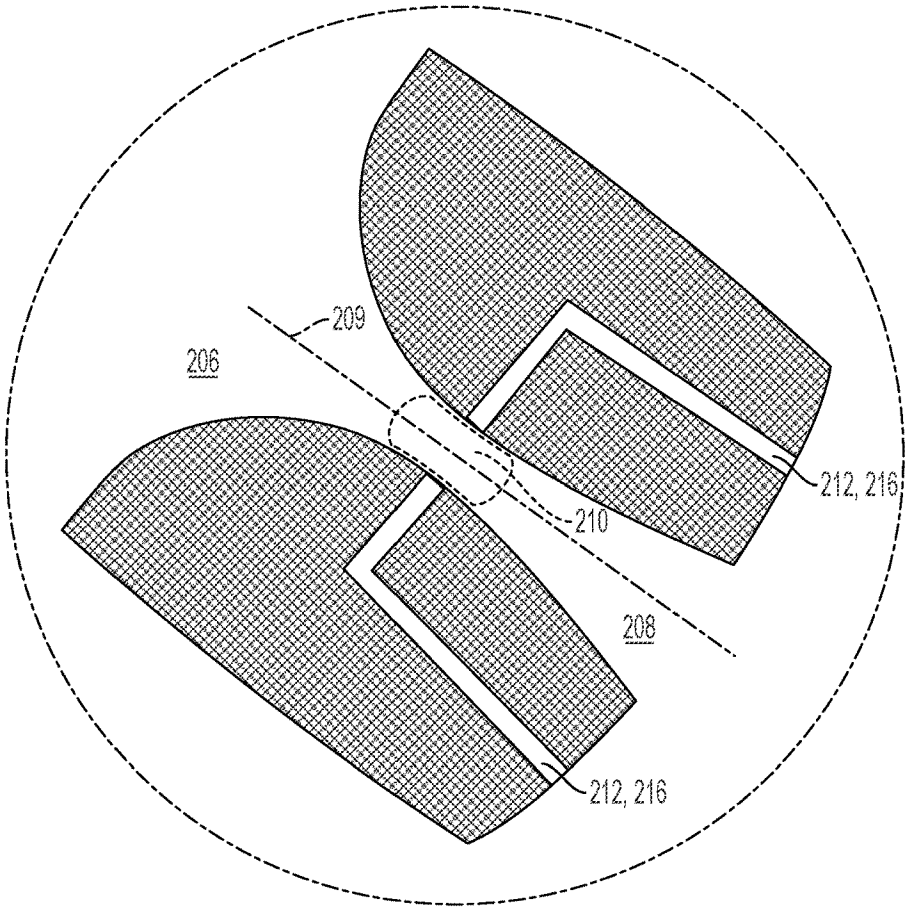
FIG. 3B is a scaled up detailed cross-sectional view of a portion of the fuel injector illustrated in FIG. 3A in accordance with the present disclosure.
Figure 3A:
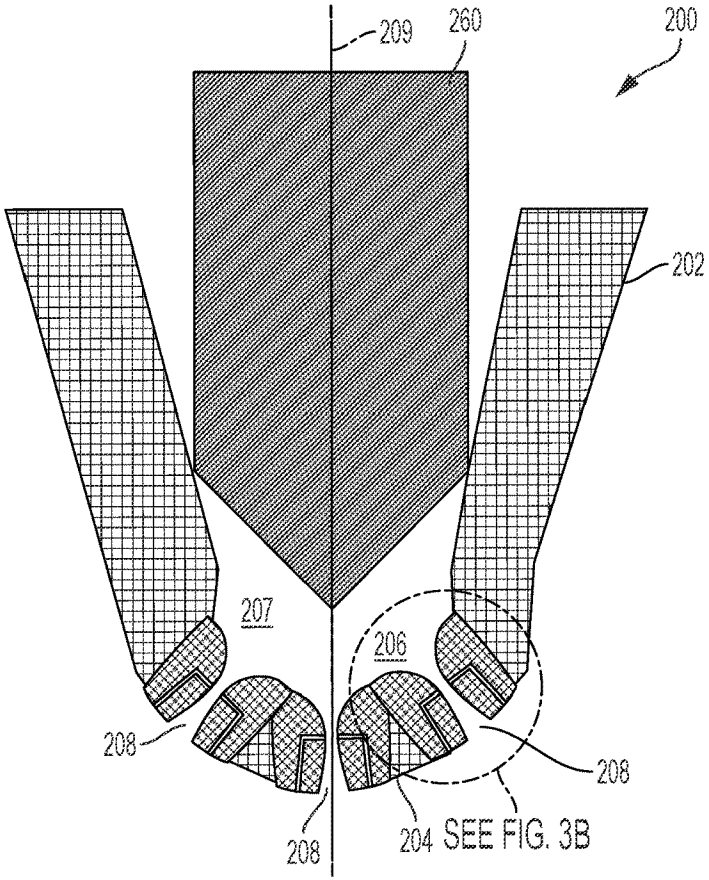
FIG. 3A is a cross-sectional view of a valve body of a fuel injector in accordance with the present disclosure.
Figure 4B:
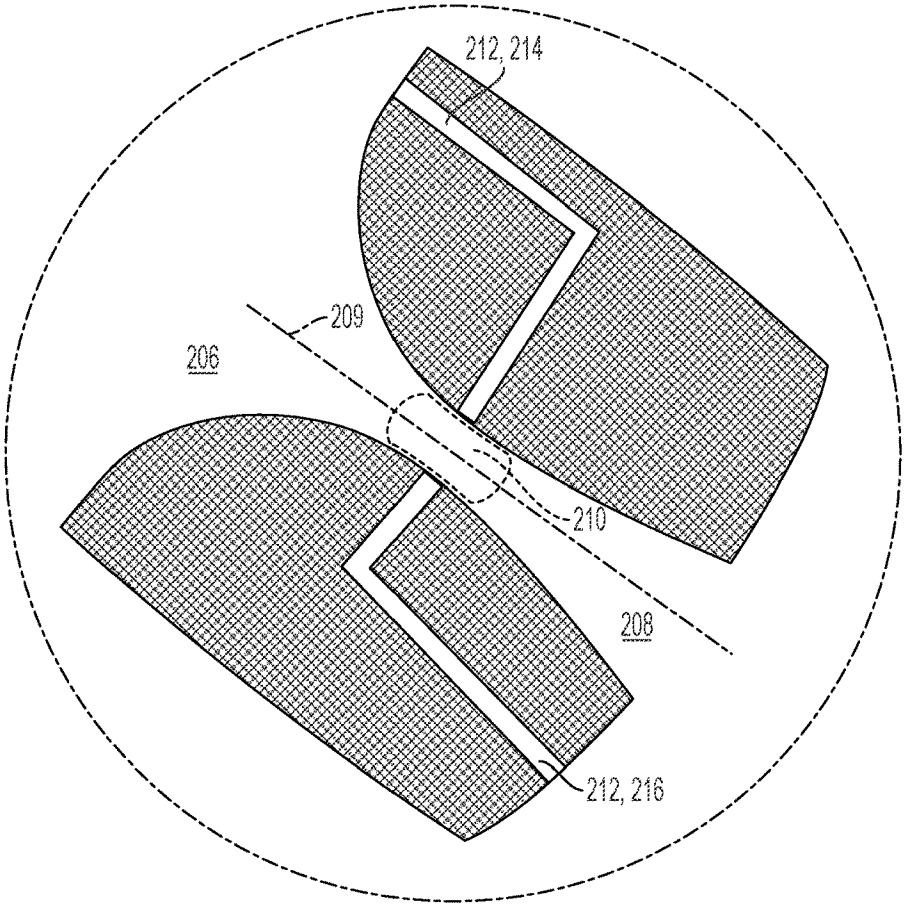
FIG. 4B is a scaled up detailed cross-sectional view of a portion of the fuel injector illustrated in FIG. 4A in accordance with the present disclosure.

FIGS. 2A through 4B are cross-sectional views illustrating various example fuel injectors 200 in accordance with the present disclosure. FIGS. 2B, 3B, and 4B are detailed views of portions of FIGS. 2A, 3A, and 4A respectively. A fuel injector 200 may include an injector body 202. The fuel injector 200 may have an end 204 of the injector body 202 that may be configured to be positioned into a combustion chamber 30, for example the combustion chamber illustrated in FIG. 1. A fuel sac 206 may be defined within the injector body 202. A main fuel passage 208 may be configured to fluidically couple the fuel sac 206 to the combustion chamber 30. The main fuel passage 208 may have a varying cross-sectional area to form a reduced pressure region 210. The reduced pressure region 210 may be effected as such by a change in flow velocity, effected in turn by a reduced cross section of the flow path, as may be described by the Venturi effect. An additional passage 212 may fluidically couple the reduced pressure region 210 with one of: the fuel sac 206, and the combustion chamber 30.

The main fuel passage 208 may be formed in, through, or with, a wall of the injector body 202. The main fuel passage 208 may be made integral with the injector body 202, or it may be formed in, or through, an additional element that may be added to, or coupled with, the injector body 202. A varying cross-sectional area may refer to a cross-sectional area that may be relatively larger or smaller as measured at various positions on a longitudinal axis 209 of the main fuel passage 208.

FIGS. 2A-4B illustrates an example embodiment with, as described herein, at least one additional passage 212 fluidically coupling the reduced pressure region 210 with the fuel sac 206. It will be understood that, instead, one, three, or more additional passages 212 may fluidically couple the reduced pressure region 210 with the fuel sac 206.

In some cases, the main fuel passage 208 may have a reducing cross-sectional portion 230 that may define a frusto-conical shape, and an increasing cross-sectional portion 232 that may also, or instead define a frusto-conical shape. The surfaces of the respective frusto-cones 234, 236 may be straight, or curvilinear as shown in the illustrated examples.

The term additional passage, or passages, may refer to one or more additional passages 212 of the types described herein. For example, one or more of a first additional passage 214 may extend from the reduced pressure region 210 to the fuel sac 206, and one or more of a second additional passage 216 may extend from the reduced pressure region 210 to the combustion chamber 30. In addition, it will be understood that various elements included in the particular examples illustrated in the figures may be combined with elements in the other figures and may be used in various quantities and arrangements.

Figure 4A:
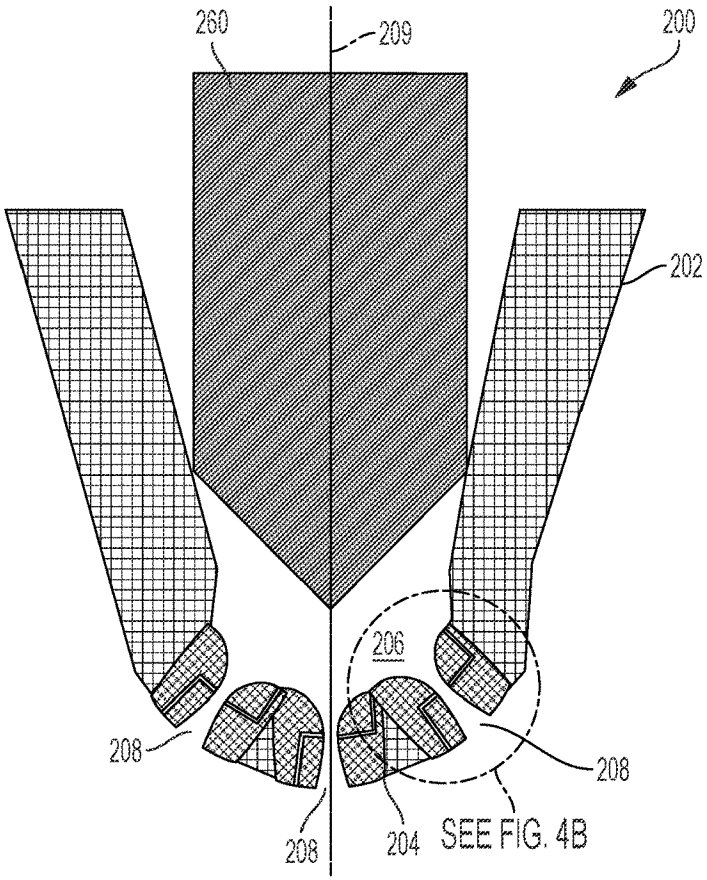
FIG. 4A is a cross-sectional view of a valve body of a fuel injector in accordance with the present disclosure.
Figure 5B:
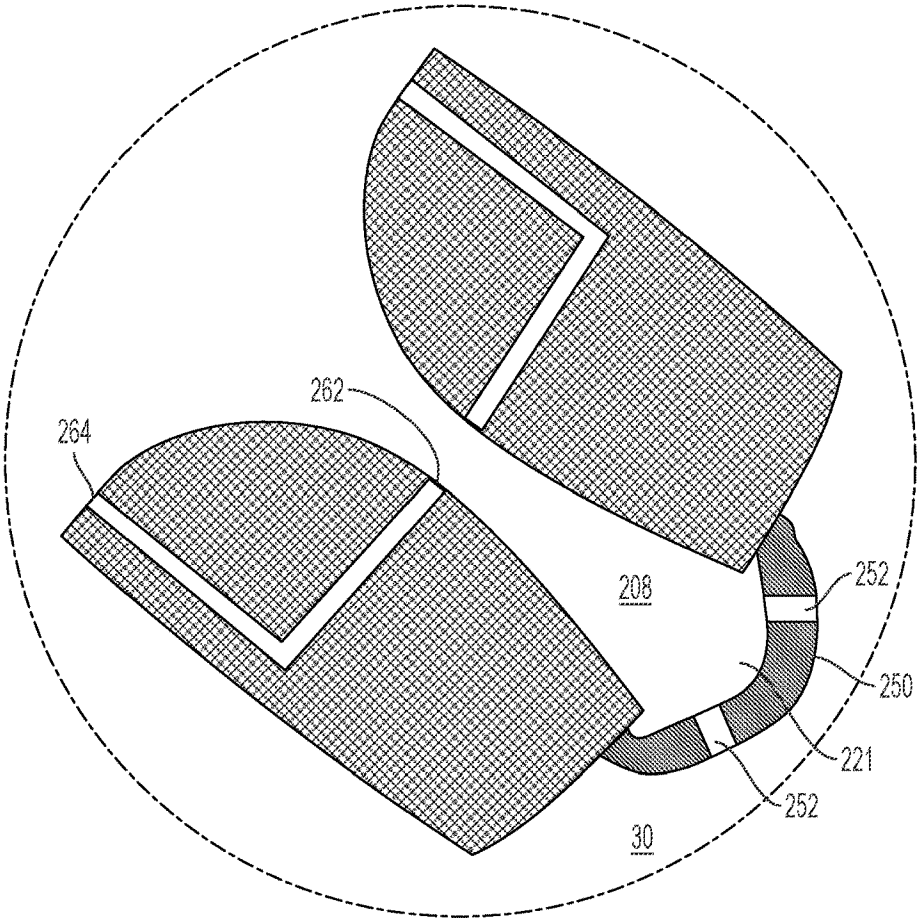
FIG. 5B is a scaled up detailed cross-sectional view of a portion of the fuel injector illustrated in FIG. 5A in accordance with the present disclosure.
Figure 5A:
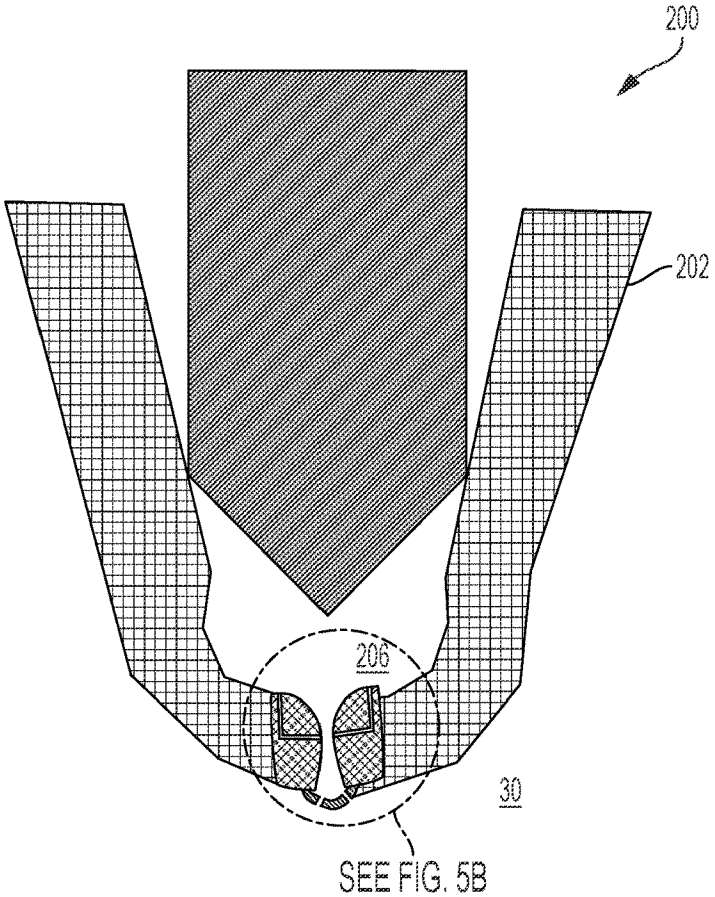
FIG. 5A is a cross-sectional view of another example a fuel injector including a wall with apertures over a passage outlet in accordance with the present disclosure.

In some examples the additional passage may be a first additional passage 214. The fuel injector 200 may also, or instead, include a second additional passage 216 wherein the first additional passage 214 may couple the reduced pressure region 210 with the fuel sac 206, as shown in FIGS. 2A-2B (and in FIGS. 5A-5B discussed later), and the second additional passage 216 may couple the reduced pressure region 210 with the combustion chamber 30, as shown in FIGS. 3A-3B (and in FIG. 6 discussed later). Some example embodiments may include a first additional passage 214 and a second additional passage 216 as shown in FIGS. 4A-4B (and in FIG. 7 discussed later).

In some examples the additional passage 212 may terminate at the reduced pressure region in a direction substantially perpendicular to a direction of flow of the main fuel passage 208. In particular, the first additional passage 214, and/or the second additional passage 216, may terminate at the reduced pressure region in a direction substantially perpendicular to a direction of flow of the main fuel passage 208. In this way, the flow of fuel may be particularly well atomized and the fuel penetration into the combustion chamber 30 may be particularly well controlled.

Figure 8:
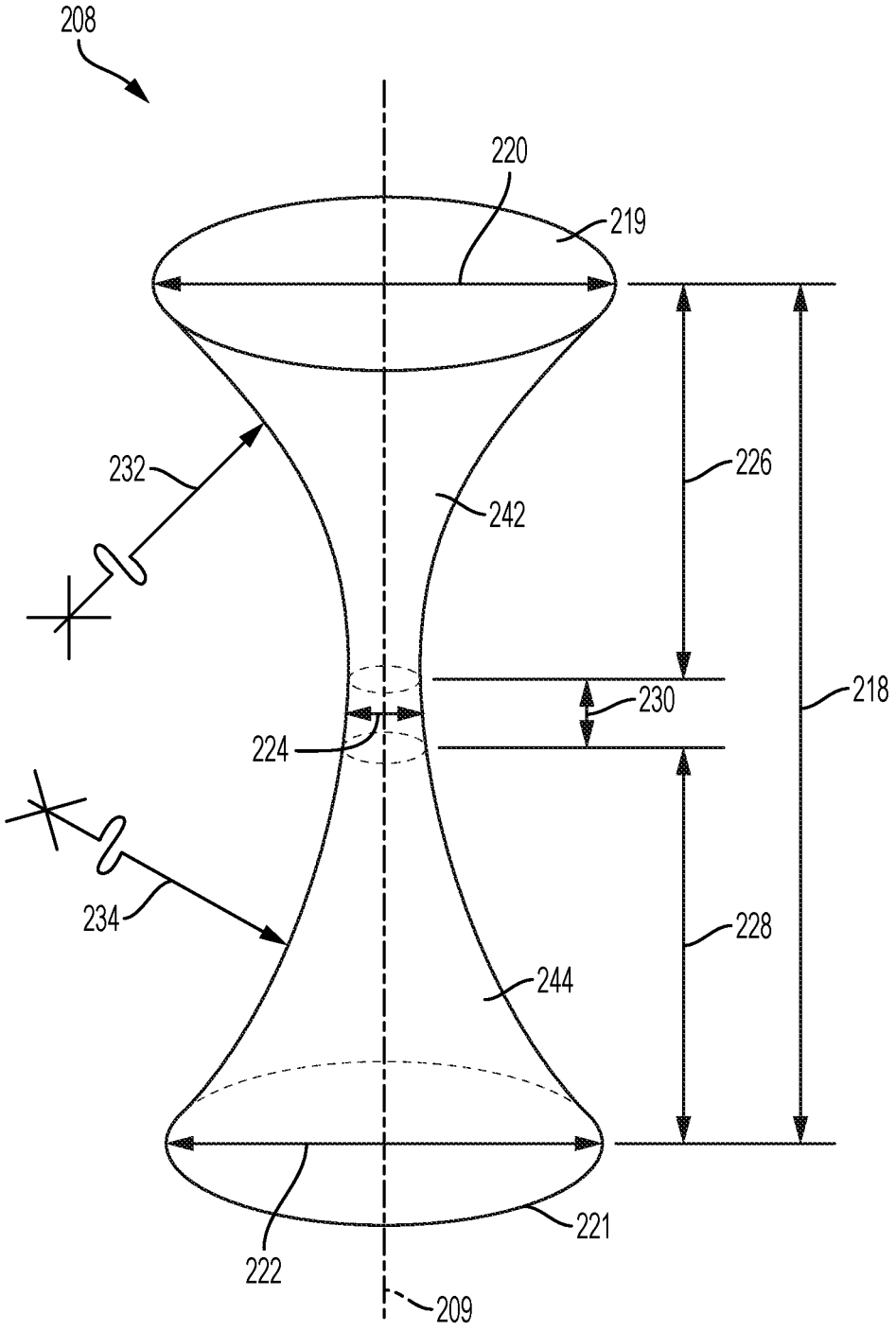
FIG. 8 is a side view illustrating example shapes and relative sizes of a main fuel passage in accordance with the present disclosure.

FIG. 8 is a side view illustrating example shapes and relative sizes of the main fuel passage 208 in accordance with the present disclosure. The main fuel passage 208 may have a passage length, as indicated with arrow 218, of a predetermined length. The main fuel passage 208 may be Venturi shaped. The main fuel passage 208 may have an inlet 219 with an inlet diameter indicated with arrow 220, an outlet 221 with an outlet diameter indicated with arrow 222, and a reduced pressure region diameter indicated with arrow 224. The main fuel passage 208 may have an inlet cone length as indicated with arrow 226, an outlet cone length as indicated with arrow 228, and a reduced pressure region length indicated with arrow 230. The inlet cone and the outlet cones may either or both define frusto-cones. The inlet frusto-cone 242 may have a curved surface radius as indicated with arrow 232, and outlet frusto-cone 244 may have a curved surface radius as indicated with arrow 234.

As illustrated, in some example embodiments the radius of the inlet frusto-cone, arrow 232, may be less than the radius of the inlet frusto-cone, arrow 234. In some example embodiments the inlet cone length, arrow 226, may be shorter than an outlet cone length, arrow 228. Other combinations and relationships are possible.

Various sizes may be used in various embodiments in accordance with the disclosure. For example the inlet cone length, arrow 226, may be substantially from 0.8 to 1 mm. The main fuel passage 208 may have an inlet diameter, arrow 220, of from substantially 1.5 to 2 mm, and outlet diameter, arrow 222, may be substantially from 1.5 to 2 mm. The reduced pressure region may have a diameter, arrow 224, from 0.2 to 0.3 mm. In another example, embodiments may include a Venturi shaped nozzle including nozzle length, arrow 218, that may range substantially from 5 to 8 mm. The inlet diameter, arrow 220, may range substantially from 4 to 6 mm. The outlet diameter may range substantially from 4 to 6 mm. Other sizes may be used.

Embodiments may provide multiple main fuel passages 208. Each may be provided with a corresponding additional fuel passage 212 configured similarly. The multiple main fuel passages 208 may be arranged evenly spaced circumferentially around the injector body 202.

Figure 6:
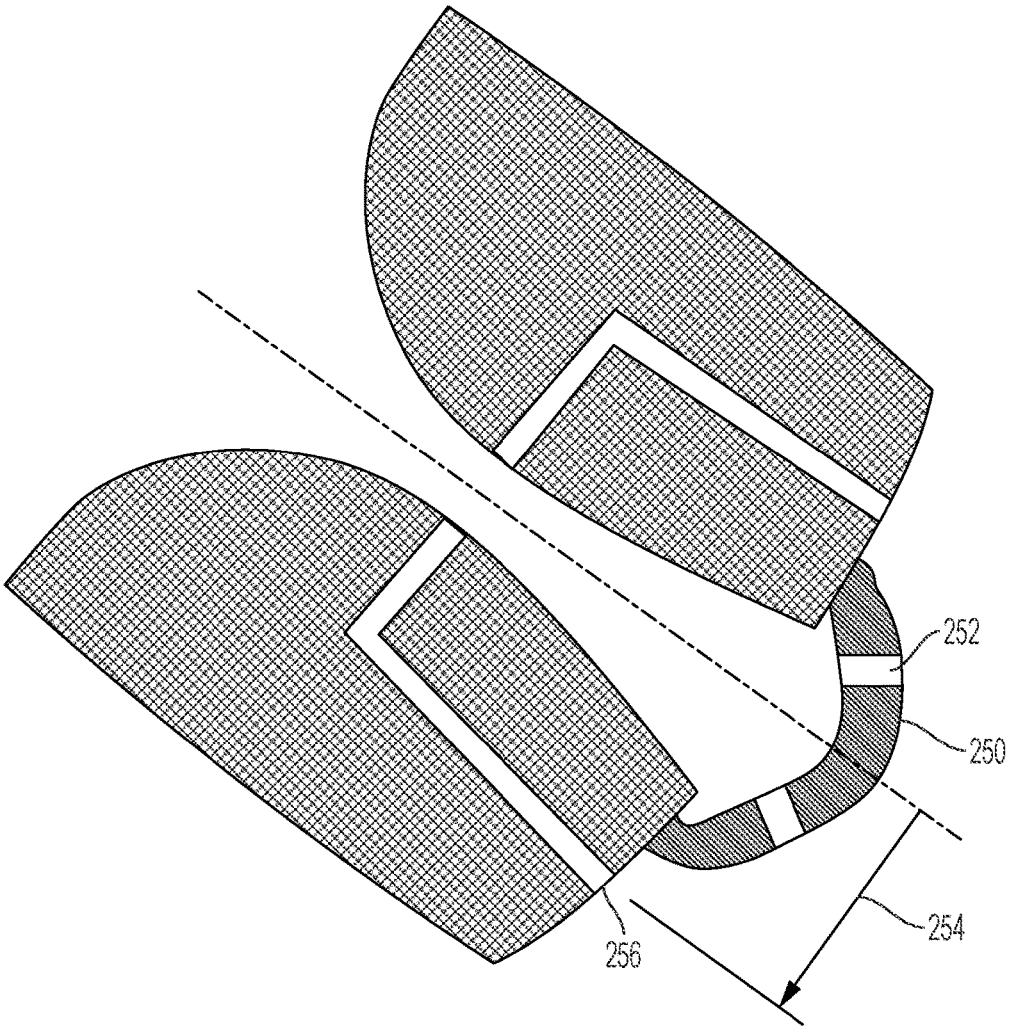
FIG. 6 is a scaled up detailed cross-sectional view of another example fuel injector in accordance with the present disclosure.
Figure 7:
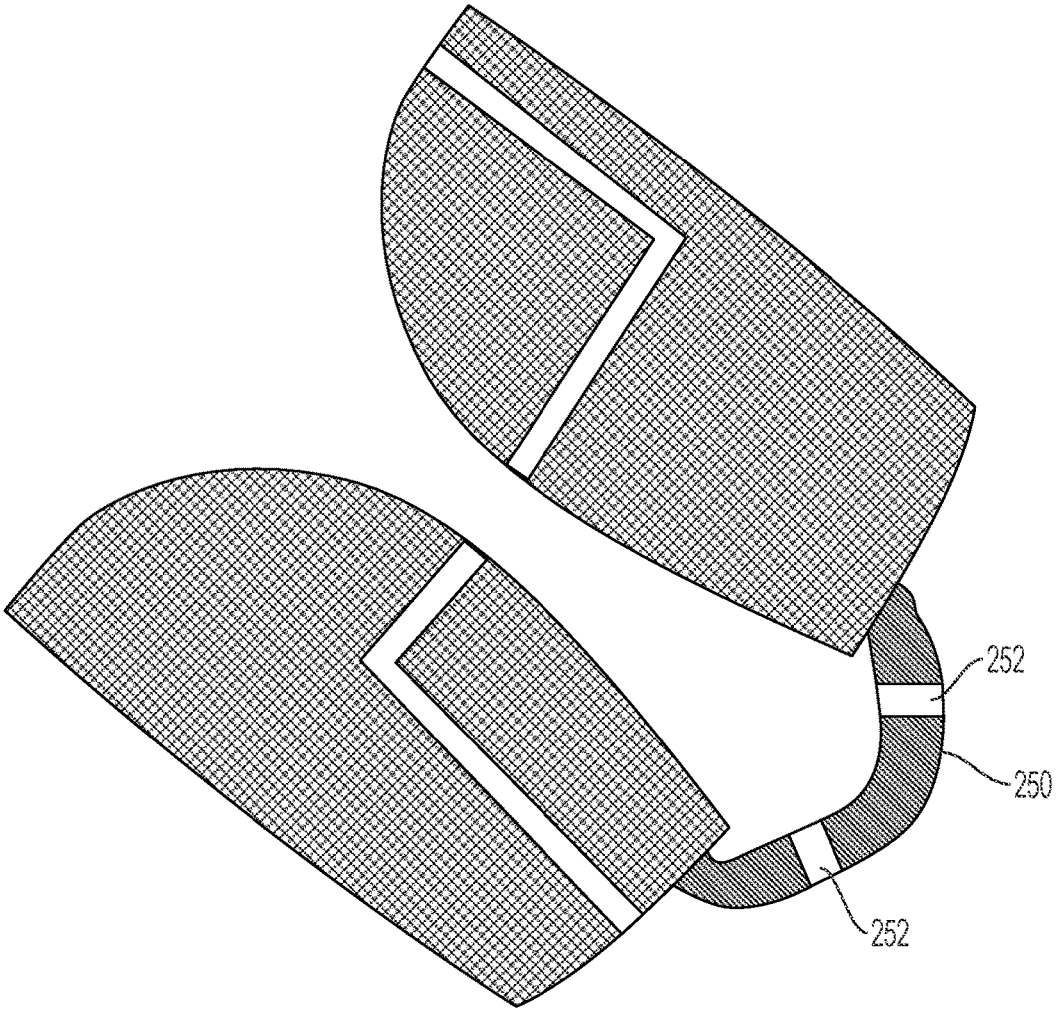
FIG. 7 is a scaled up detailed cross-sectional view of another example fuel injector in accordance with the present disclosure.

Some example embodiments may provide a fuel injector 200 that may include a dome shaped wall 250 disposed over the outlet 221 of the main fuel passage 208 having two or more apertures 252 to allow fuel to pass from the main fuel passage 208 into the combustion chamber 30. Referring to FIG. 6, a radial direction 254 is indicated with an arrow. The additional fuel passages 212, in this case second additional passages 216, may be open to the combustion chamber 30 at a location 256 radially outside of the dome shaped wall 250. In this way, a particularly low static pressure at the region right after the neck region may be present. This low static pressure may be used to deliver hot air from the combustion cylinder to the neck region of the injector for the spray impingement to increase the turbulence and promote flash boiling for faster spray atomization. Embodiments may also tend to promote spray atomization through creating cavitation at the nozzle neck region where very low static pressure may be generated due to flow acceleration.

Example embodiments may provide a fuel injector 200 that may include an injector body 202. A fuel sac 206 may be defined inside the injector body 202. An injector needle 260 may be disposed for movement within the injector body 202 to pressurize fuel within the fuel sac 206. One or more Venturi shaped nozzle passages 208 may extend from the fuel sac 206 to an outside end 204 of the injector body 202. The nozzle passages 208 may include a throat region 211 between a nozzle inlet 219 and a nozzle outlet 221 at the outside end 204. One or more flow joining passages 213 may fluidically couple the throat region 211 to one or both of the fuel sac 206 and a side of the nozzle outlet 221.

The one or more flow joining passages 213 may fluidically couple the throat region 211 to the fuel sac 206 and wherein fuel passing through the throat region may form a pressure at a first end 262 of the one or more flow joining passages 213 to force fuel to pass from the fuel sac into the throat region.

The outside end 204 of the injector body 202 may be positionable into a combustion chamber 30 of an internal combustion engine. The one or more flow joining passages 213 may couple the throat region 211 to a side of the nozzle outlet 221 wherein passing fuel through the throat region 211 may create a region of low pressure to the side of the nozzle outlet 221. In this way, the low pressure created may tend to widen the stream of fuel passing from the outlet 221. In this way, improved mixing and reduced penetration may be accomplished.

The outside end 204 of the injector body may be positionable into a combustion chamber 30 of an internal combustion engine, and the one or more flow joining passages 213 may couple the throat region 211 to the combustion chamber 30 at a second end 264 thereof wherein passing fuel through the throat region creates a region of low pressure to pull gas from the combustion chamber into the throat region. In this way, the fuel may be warmed within the main fuel passage 208.

The fuel injector 200 may also include a wall 250 extending over the nozzle outlet 221. The wall 251 may have two or more spaced apart apertures 252 to allow fuel to pass through the wall 250. The wall 251 may be a bulbous wall 251 extending from outside an annular edge 266 of the nozzle outlet 221 outwardly and over the nozzle outlet 221. The wall 251 may have two or more spaced apart apertures 252 to allow fuel to pass through the wall and into a combustion chamber 30 of an internal combustion engine. At least one of the flow joining passages 213 may extend from the throat region 211 to a side of the wall 251 radially outside of the annular edge 266.

The fuel injector 200 may include multiple Venturi shaped nozzle passages 208 evenly spaced and arranged circumferentially around a central axis 209 of the injector body 202. Each Venturi shaped nozzle passage 208 may have at least one flow joining passage 213 fluidically coupling respective the multiple throat regions 211 to one or both of the fuel sac 206 and a combustion chamber 30 of an internal combustion engine. The at least one flow joining passage 213 may intersects with each throat region substantially perpendicularly.

Embodiments may provide a fuel injector 200 that may include an internal cavity 207 to receive fuel and the hold a quantity of fuel for pressurization. An injection passage 208 may be provided through which pressurized fuel may be passable from the internal cavity 207 into a combustion chamber 30. The injection passage 208 may have a constricted portion 268 to form a low pressure region 210 in the injection passage 208. A flow joining passage 213 may fluidically couple the low pressure region 210 with either the internal cavity 207 or the combustion chamber 30.

The flow joining passage 213 may be a first flow joining passage 214 and the fuel injector 200 may also include a second flow joining passage 216. A pressurized fuel may flow through the injection passage 208 as a main flow. Some fuel may pass from the internal cavity 207 through the first joining passage 214 to join the main flow at the low pressure region 210, and some gas from the combustion chamber 30 may pass through the second joining passage 216 to join the main flow at the low pressure region 210 to mix with the main flow. The injection passage may be Venturi shaped. The flow joining passage 213 may intersect the constricted portion 268 in a direction substantially perpendicular to a direction of flow of the pressurized fuel through the injection passage 208.

FIGS. 1-8 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly. It will be appreciated by those skilled in the art that although the present disclosure has been described by way of example with reference to one or more embodiments it is not limited to the disclosed embodiments and that one or modifications to the disclosed embodiments or alternative embodiments could be constructed without departing from the scope of the present disclosure.

Accordingly, it will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A fuel injector comprising:

an injector body;

an end of the injector body configured to be positioned into a combustion chamber;

a fuel sac defined within the injector body;

a main fuel passage to fluidically couple the fuel sac to the combustion chamber, and having a varying cross-sectional area to form a reduced pressure region;

a dome shaped wall disposed over an outlet of the main fuel passage having two or more apertures to allow fuel to pass from the main fuel passage into the combustion chamber; and an additional passage fluidically coupling the reduced pressure region with one of the fuel sac and the combustion chamber.

2. The fuel injector of claim 1, wherein the additional passage is a first additional passage, and further comprising a second additional passage wherein the first additional passage couples to the reduced pressure region with the fuel sac and the second additional passage couples to the reduced pressure region with the combustion chamber.

3. The fuel injector of claim 1, wherein the additional passage terminates at the reduced pressure region in a direction substantially perpendicular to a direction of flow of the main fuel passage.

4. The fuel injector of claim 1, wherein the main fuel passage is venturi shaped.

5. The fuel injector of claim 3, wherein the main fuel passage has a venturi shape, and an inlet cone length from 0.8 to 1 mm, an inlet diameter from 1.5 to 2 mm, an outlet diameter from 1.5 to 2 mm, and a diameter at the reduced pressure region from 0.2 to 0.3 mm.

6. The fuel injector of claim 1, further comprising multiple main fuel passages each with a corresponding additional fuel passage configured similarly and arranged evenly spaced circumferentially around the injector body.

7. The fuel injector of claim 1, wherein the additional fuel passage is open to the combustion chamber at a location radially outside of a dome shaped wall.

8. A fuel injector comprising:

an injector body;

a fuel sac defined inside the injector body;

an injector needle disposed for movement within the injector body to pressurize fuel within the fuel sac;

one or more venturi shaped nozzle passages from the fuel sac to an outside end of the injector body including a throat region between a nozzle inlet and a nozzle outlet at the outside end;

a wall extending over the nozzle outlet, the wall having two or more spaced apart apertures to allow fuel to pass through the wall; and one or more flow joining passages fluidically coupling the throat region to one or both of the fuel sac and a side of the nozzle outlet.

9. The fuel injector of claim 8, wherein the one or more flow joining passages fluidically couples the throat region to the fuel sac and wherein fuel passing through the throat region forms a pressure at a first end of the one or more flow joining passages to force fuel to pass from the fuel sac into the throat region.

10. The fuel injector of claim 8, wherein the outside end of the injector body is positionable into a combustion chamber of an internal combustion engine, and the one or more flow joining passages couples the throat region to a side of the nozzle outlet wherein passing fuel through the throat region creates a region of low pressure to the side of the nozzle outlet.

11. The fuel injector of claim 8, wherein the outside end of the injector body is positionable into a combustion chamber of an internal combustion engine, and the one or more flow joining passages couples the throat region to the combustion chamber at a second end thereof wherein passing fuel through the throat region creates a region of low pressure to pull gas from the combustion chamber into the throat region.

12. The fuel injector of claim 8, further comprising a bulbous wall extending from outside an annular edge of the nozzle outlet outwardly and over the nozzle outlet, the wall having two or more spaced apart apertures to allow fuel to pass through the wall and into a combustion chamber of an internal combustion engine, at least one of the flow joining passages extending from the throat region to a side of the wall radially outside of the annular edge.

13. The fuel injector of claim 8, further comprising multiple venturi shaped nozzle passages evenly spaced and arranged circumferentially around a central axis of the injector body, each venturi shaped nozzle passage having at least one flow joining passage fluidically coupling respective multiple throat regions to one or both of the fuel sac and a combustion chamber of an internal combustion engine.

14. The fuel injector of claim 8, wherein the one or more flow joining passage intersects with each throat region substantially perpendicularly.

15. A fuel injector comprising:

an internal cavity to receive fuel and to hold a quantity of fuel for pressurization;

an injection passage through which pressurized fuel is passable from the internal cavity into a combustion chamber, the injection passage having a constricted portion to form a low pressure region in the injection passage; and a flow joining passage fluidically coupling the constricted portion with the internal cavity, wherein the flow joining passage is a first flow joining passage and further comprising a second flow joining passage, wherein the pressurized fuel flows through the injection passage as a main flow, and some fuel passes from the internal cavity through the first flow joining passage to join the main flow at the low pressure region, and some gas from the combustion chamber passes through the second flow joining passage to join the main flow at the low pressure region to mix with the main flow.

16. The fuel injector of claim 15, wherein the injection passage is venturi shaped.

17. The fuel injector of claim 15, wherein the flow joining passage intersects the constricted portion in a direction substantially perpendicular to a direction of flow of the pressurized fuel through the injection passage.

18. The fuel injector of claim 15, wherein the second flow joining passage fluidically couples the constricted portion with the combustion chamber.

19. The fuel injector of claim 15, wherein a first portion of the flow joining passage extends substantially perpendicular to the constricted portion and a second portion extends substantially perpendicular to the first portion.

* * * * *